US005088550A

United States Patent [19]

Tippman et al.

[11] Patent Number: 5,088,550

[45] Date of Patent: Feb. 18, 1992

[54] RADIAL FLOW HEAT EXCHANGER

[76] Inventors: Joseph R. Tippman, HRC-33, Box 8419, Rapid City, S. Dak. 57701; Vincent P. Tippmann, 8605 N. River Rd., New Haven, Ind. 46774

[21] Appl. No.: 686,148

[22] Filed: Apr. 16, 1991

[51] Int. Cl.[5] ..... F28D 3/00

[52] U.S. Cl. ..... 165/117; 165/125; 165/156; 165/162

[58] Field of Search ..... 165/115, 117, 125, 162, 165/163, 156

[56] References Cited

U.S. PATENT DOCUMENTS 2,348,601 5/1944 Buschow et al. ..... 165/117 X
3,146,609 9/1964 Engalitcheff, Jr. ..... 165/117 X
3,720,259 3/1973 Fritz et al. ..... 165/162
4,201,262 5/1980 Goldstein ..... 165/117

*Primary Examiner*—Allen J. Flanigan
*Attorney, Agent, or Firm*—Joseph J. Baker

[57] ABSTRACT

A heat exchanger for fluids is disclosed having a support assembly for the coil bundle which comprises two vertically spaced-apart support members between which the coil bundle of the exchanger is positioned. The bundle comprises a plurality of vertically spaced tubes each having a number of convolutions which slope upwardly and proceed outwardly to form the bundle. A bridge member having spaced-apart scalloped portions is provided which separate the convolutions of each tube to permit air and water to circulate therebetween. The support members have means for varying the slope of the bridge members depending on the nature of the fluid entering the exchanger.

8 Claims, 4 Drawing Sheets

RADIAL FLOW HEAT EXCHANGER

BACKGROUND OF THE INVENTION

This invention relates to a heat exchange unit for fluids and more specifically to a novel heat exchanger which functions as an evaporation-type cooler having means for spacing and supporting the individual convolutions of a coil bundle at various slopes.

Heat exchanges of the type having a coil bundle comprising a plurality of vertically spaced tubes having numerous outwardly proceeding convolutions which slope either upwardly or downwardly are not new. U.S. Pat. Nos. 3,077,226 and 3,712,370 are typical of this type of heat exchanger, however, none disclose a means for keeping the convolutions in spaced-apart relationship to permit the free flow of air between the convolutions or a means for easily varying the slope at which the convolutions are positioned to thereby permit trapped air in a liquid to leave the exchanger or liquid in a gas to remain.

Applicant's support assembly comprises the use of a number of pairs of vertically spaced-apart channel members between which the coil bundle is positioned. The coil bundle comprises a plurality of vertically spaced tubes for carrying the fluid, usually to be cooled, having a number of convolutions which slope upwardly or downwardly and proceed outwardly to the larger diameter convolutions. A bridge member having spaced-apart scalloped portions is provided which is positioned over the convolutions to separate them to thereby permit air and water to circulate. In addition, the tubes can be wound directly onto the support members in a circular fashion as they come from the tube forming machine thus greatly reducing time and labor required to form the coil bundle. The channel members have spaced-apart recesses into which the ends of the bridge member can be inserted to vary the slope of the bridge member and therefore the tubes of the bundle.

It is therefore the primary object of the present invention to provide a radial flow heat exchanger with a superior support assembly for the numerous convolutions of the tubes of its coil bundle.

It is another object of the invention to provide a coil bundle support assembly whereby the slope of the convolutions of each tube can be varied depending on the nature of the fluid which is to be supplied to the exchanger.

It is a further object of the invention to provide a heat exchanger with easily removable louvered side panels arranged to direct splashed water into a reservoir.

It is yet another object of the invention to provide a heat exchanger of the subject type having a support assembly for the coil bundle which is of simple construction and is relatively inexpensive to make yet is capable of enabling the tubes of the coil bundle to be supported in the desired position as they emerge from the tube forming machine position and maintained at a plurality of slopes and directions.

Other objects and features of the invention will be appreciated and become apparent as the present disclosure proceeds and upon consideration of the accompanying drawing and the following detailed description wherein an exemplary embodiment of the invention is disclosed.

IN THE DRAWINGS

DETAILED DESCRIPTION

Figure 1:
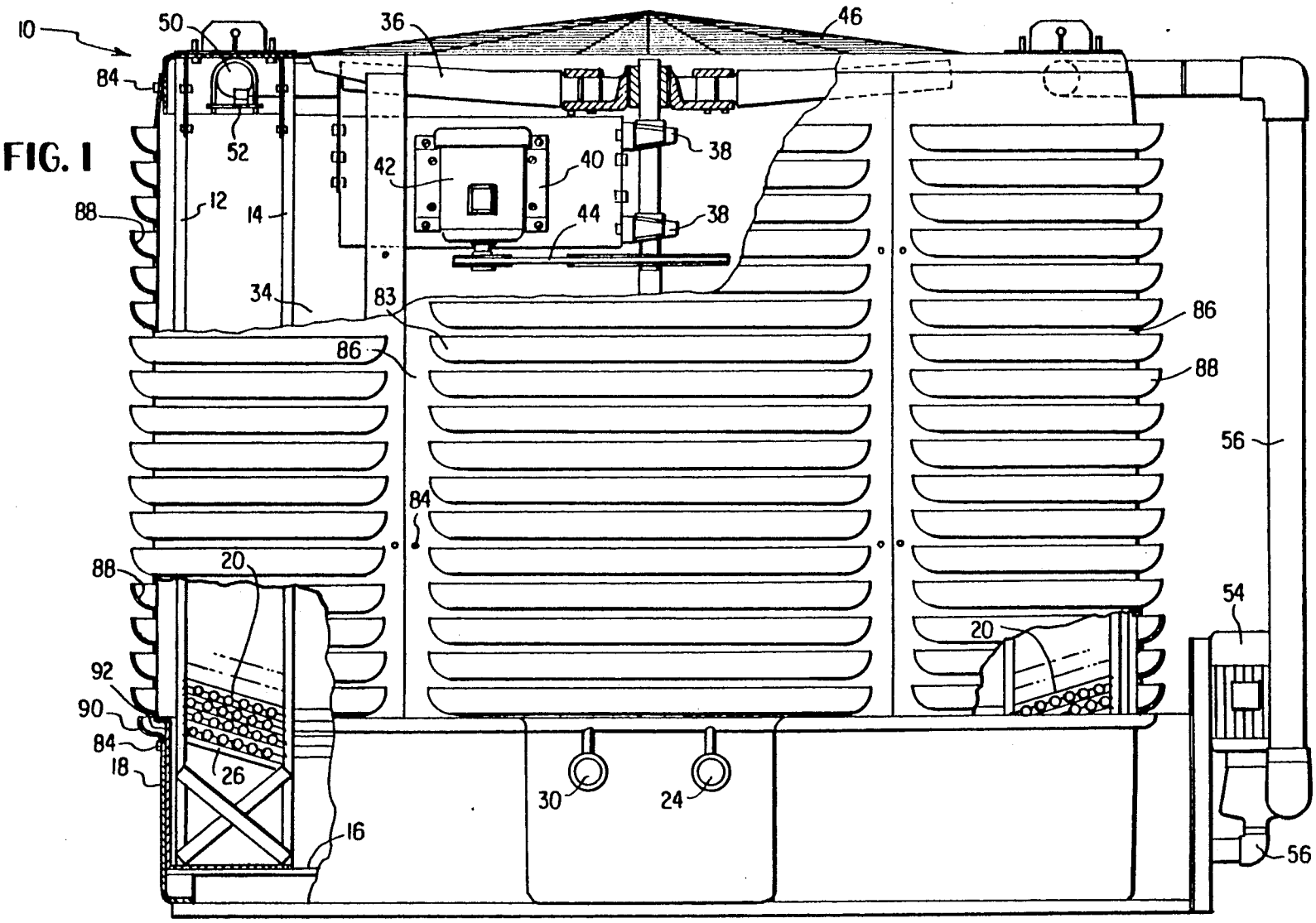
FIG. 1 is an elevational view of the heat exchanger partially broken away and partially in cross section.
Figure 2:
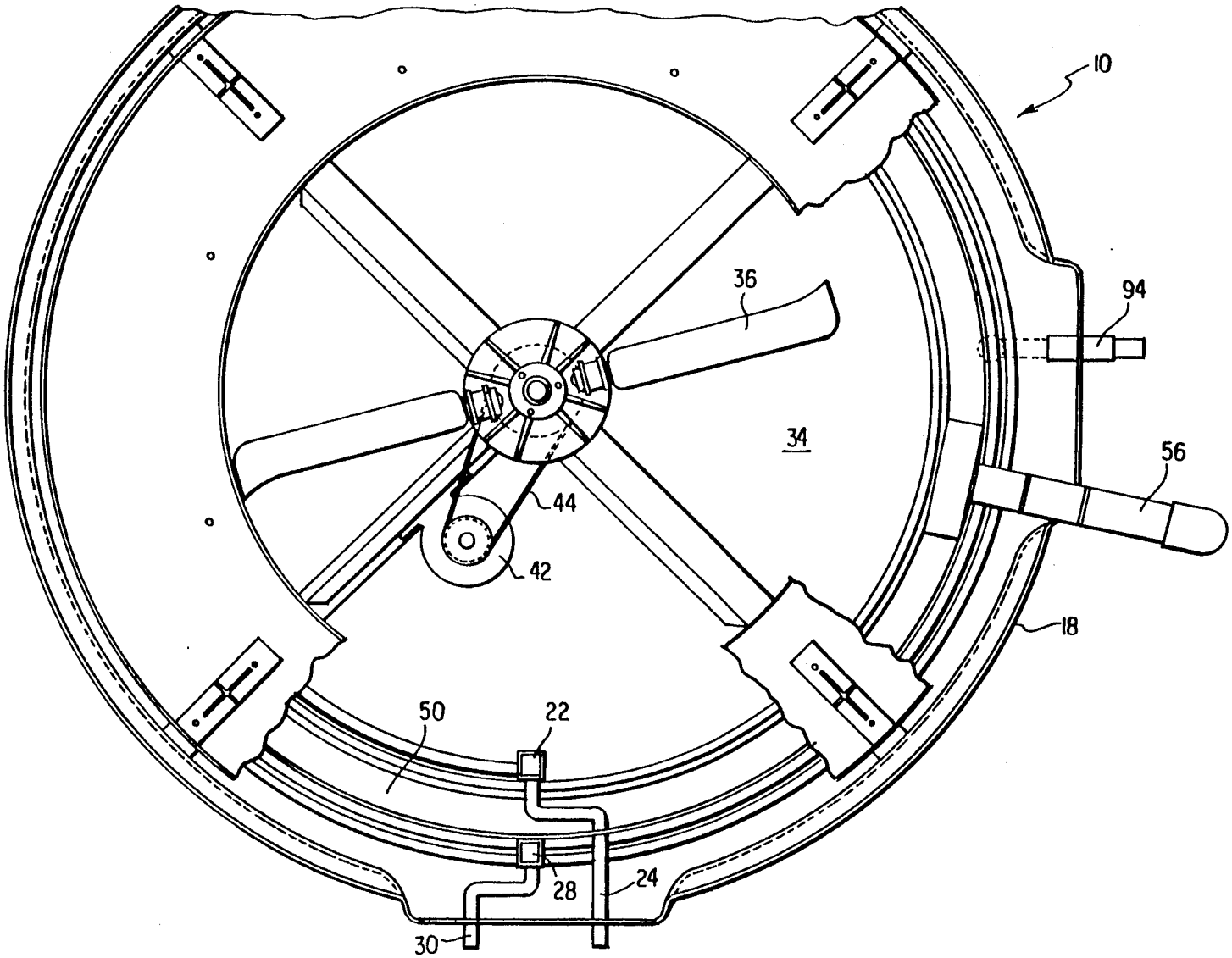
FIG. 2 is a partially broken away plan view of the exchanger of FIG. 1.

Referring now to the drawings where like reference numerals indicate like elements in each of the several views, numeral 10 of FIGS. 1 and 2 shows the heat exchanger of the present invention. The heat exchanger 10 has a plurality of vertically disposed circumferentially spaced-apart outer support members 12 and an equal number of vertically disposed inner support members 14 radially spaced from the outer support members 12. The support members 12 and 14 are secured to a base 16 and set in a pan or sump 18.

Figure 3:
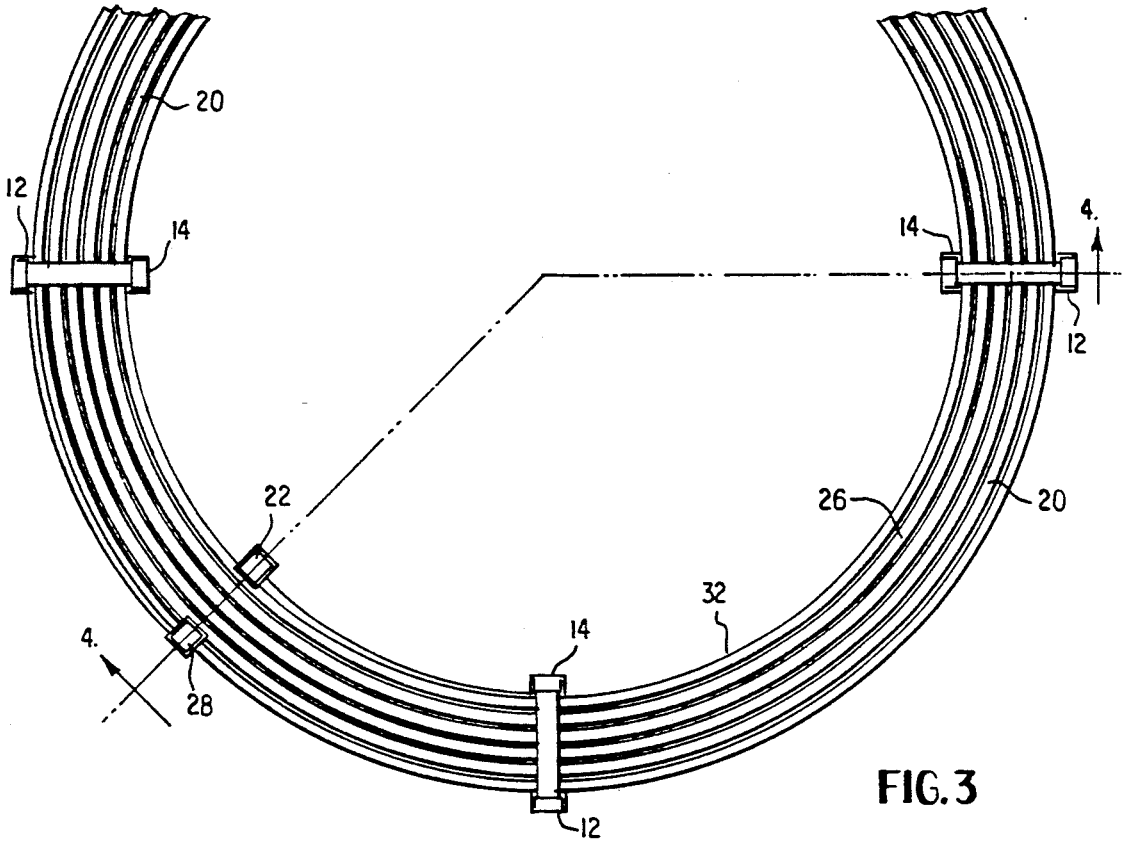
FIG. 3 is a plan view of the coil bundle.
Figure 4:
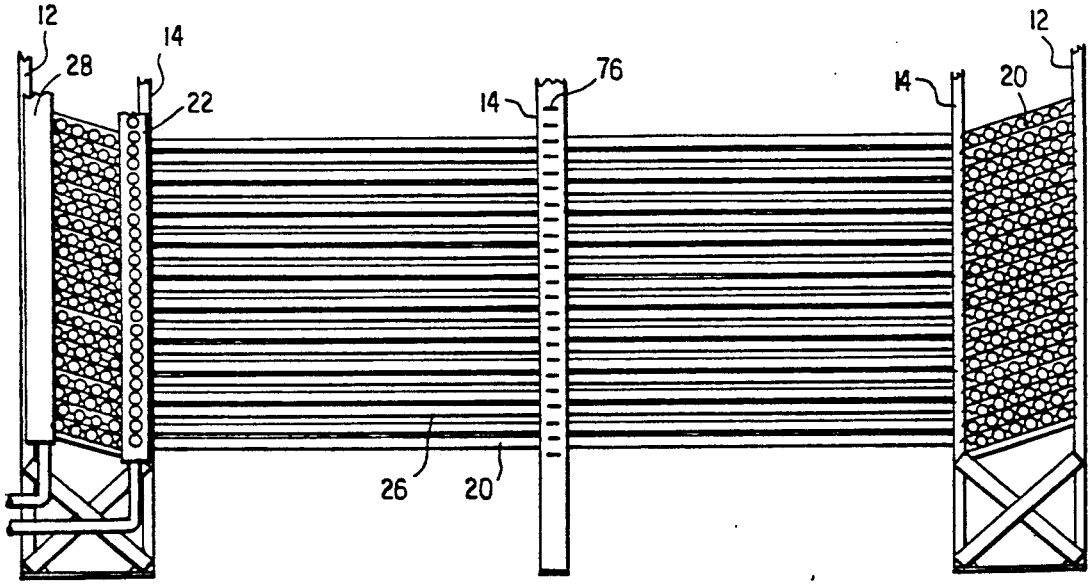
FIG. 4 is a elevational view of the coil bundle of FIG. 3 in cross-section taken along the lines 4—4 of FIG. 3.

A plurality of tubular members 20 are located between support members 12, 14 and are secured at vertically spaced points to an inlet header 22 for receiving the fluid to be cooled by way of connection piping 24 as shown in FIGS. 3 and 4. As will be noted, the direction of fluid flow from the inlet header 22 to the outlet header 28 is in a direction opposite to the direction of air travel over the tubular members 20 for maximum heat transfer. Each tube 20 has a plurality of convolutions which proceed outwardly from the inlet header 22 to the larger diameter to thereby, when stacked on top of each other, form an annular assembly or bundle 26. A vertically disposed outlet header 28 is connected to each of the tubes 20 at the outer periphery of the bundle 26 and it discharges the fluid to be cooled by way of connection piping 30. The inner convolutions 32 of the tube 20 form an unobstructed central area 34 within which a fan 36 is rotatably mounted by means of bearings 38 which are in turn secured to a plate 40. An electric motor 42 drives the fan 36 by way of drive belt 44 to thereby draw air from the outside, over the coil bundle 26 into the central area 34 and out through exhaust screen 46. A circular header pipe 50 is mounted between the support members 12, 14 above the coil bundle 26 to disperse coolant water over the tubes 20 from a plurality of nozzles 52. The coolant water falls into the pan 18 whereupon it is circulated back to the header pipe 50 by means of an electric motor driven pump 54 via piping 56. A water receiving trough (not shown) having a plurality of drain holes in the bottom thereof could be used in place of the header pipe 50 and nozzles 52.

Figure 5:
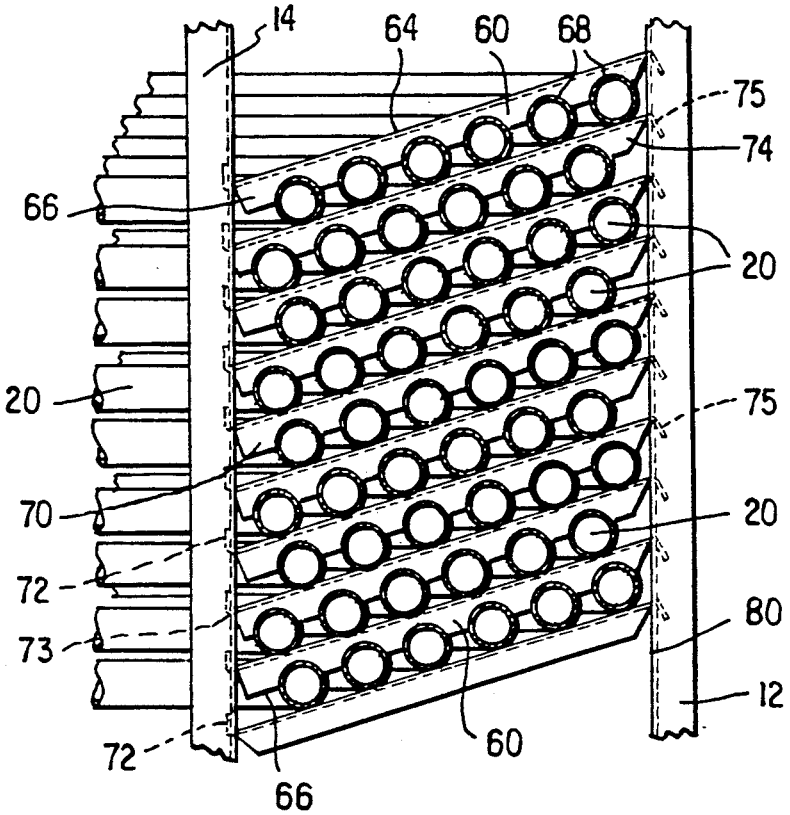
FIG. 5 is an exploded view of the coil bundle of FIG. 4.
Figure 6:
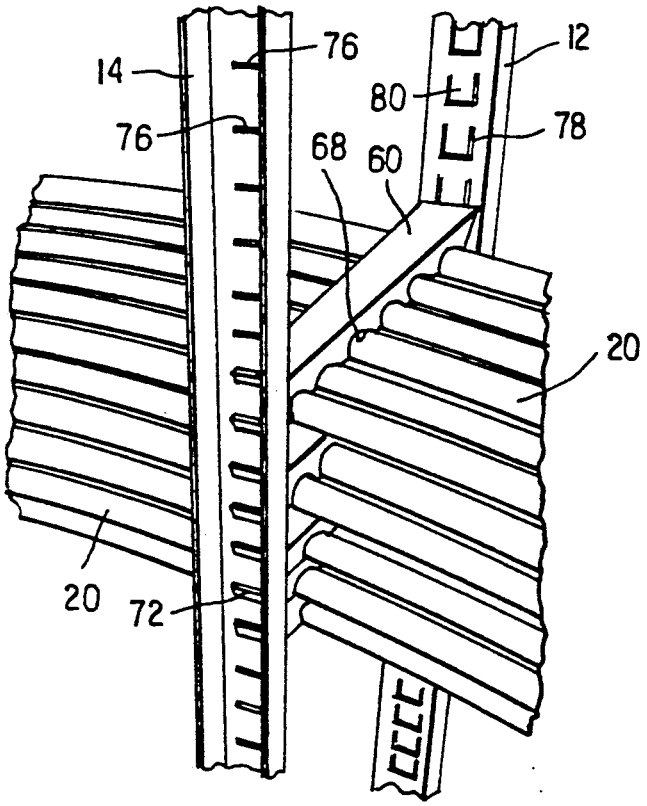
FIG. 6 is a perspective view in elevation of a portion of the coil bundle.

The convolutions of tubes 20 are supported in their spaced apart horizontal relationship, as well as in their vertical relationship relative to adjacent tubes above and below, by means of applicant's unique bridge members 60 as can best be seen by referring to FIGS. 4, 5 and 6. The bridge members 60 may be installed to slope the convolutions of each tube upward from left to right as viewed in FIG. 5 if, for example, it is desirable to ensure that condensation will flow through the tubing back to the inlet header 22 if the medium to be cooled is a gas or to permit gaseous bubbles to rise to the outlet header 28 if the medium to be cooled was a liquid. If, however, it is desirable to have the medium flow through the tubes 20 in the same direction as the movement of air over the tubes, i.e. from the outside to the inside convolution, then the bridge member 60 could be positioned to slope the convolutions of each tube downward from the inner most convolution to the outer most or if it were desired to have condensation in a gas flow toward the outlet header for removal.

Each bridge member 60 comprises an elongated body member 62 having a straight side 64 and a side 66 opposite thereto having spaced-apart scalloped portions 68 of a diameter slightly larger than the diameter of the tubes 20. The convolutions of each tube 20 are maintained in their spaced-apart relationship as they are positioned by the scalloped portions. This positioning usually takes place as the tubes emerge from the tube mill or forming machine (not shown) thereby greatly decreasing the time and manual skill required to form the coil bundle 26 thus greatly reducing its cost. Each bridge member 60 has a first end portion 70 having an upwardly extending leg 72 offset at 73 and a second end portion 74 having a downwardly extending arm 75. Referring to FIG. 6, the inner vertical support member 14 has a plurality of horizontally extending slots 76 and the outer vertical support member 12 has a plurality of U-shaped slots 78, the slots 76, 78 being spaced-apart vertically the desired distance between tubes 20.

As can be seen, installation of the bridge member 60 can be achieved rapidly by merely inserting the leg 72 into the slot such that offset 73 engages the bottom of the slot and then arm 74 is inserted in the U-shaped slot 78. In order to facilitate insertion of the arm 74, the cut-out portion 80 formed by the U-shaped slot can be slightly bent outward or to the right as viewed in FIG. 5. The convolutions of tubes 20 are then laid on side 64 of bridge member 60 and another bridge member 60 is installed to thereby evenly separate the convolutions as they reside in the scalloped portions 68. Thus, the entire tube bundle 26 can be rapidly assembled with each convolution of each tube being at the right slope and spaced evenly with respect to each other. Should it be decided to have the bridge members 60 slope in a direction opposite to that shown in FIG. 5, all that need be done is to reverse the position of the outer and inner support members 12, 14 respectively. In addition, the bridge member 60 can also be installed in the horizontal position by inserting the leg 72 and arm 75 in oppositely disposed slots 76, 78.

A plurality of curved panels 82 are positioned around the coil bundle 26 adjacent to the outer support members 12 and are secured to each other, the exhaust screen 46 and pan 18 by means of quick detachable fasteners 84. Each panel 82 has a plurality of horizontal, spaced-apart louvers 86 having an upwardly extending curved portion 88 which enables any coolant droplets to be stopped from exiting but caused to run downwardly toward the pan 18. The pan 18 is provided with a lip 90 inside of which the lower end 92 of the panel 82 is positioned and an outlet 94 for removing coolant.

Applicant has thus disclosed in detail his heat exchanger and more specifically the unique easily installed bridge member for positioning and maintaining the convolutions of each fluid carrying tube at a desired slope and spacing.

What is claimed is:

1. A radial flow heat exchanger for fluids comprising:

a. a plurality of tubes connected to an inlet header at vertically spaced points for receiving said fluid, each tube having a plurality of convolutions which slope in proceeding outwardly to the larger diameter convolutions thereof forming an annular assembly, and a vertically disposed outlet header connected to each tube at the outer periphery, said annular assembly having an open central area, b. means for drawing air over the outside of said tubes, c. means for dispensing a coolant liquid over the outside of said tubes, d. pan means beneath said annular assembly to receive said coolant liquid, e. means for supporting each of said tubes in spaced apart relationship, and f. means for varying the slope of said tubes depending on the nature of said fluid to be supplied to said exchanger.

2. An exchanger as set forth in claim 1 wherein said support means comprises:

a. a plurality of vertically disposed, circumferentially spaced-apart support members adjacent to said larger diameter convolutions, b. a plurality of vertically disposed, circumferentially spaced-apart inner tube support members adjacent the smaller diameter convolutions, each of said inner tube support members being in spaced-apart radial alignment with an outer coil support member, and c. bridge means extending between said inner and outer coil support members for supporting each of said vertically spaced plurality of convolutions in said sloping manner.

3. An exchanger as set forth in claim 2 wherein said bridge means has spaced-apart scalloped portions which separate said convolutions of each tube to permit said air and water to circulate therebetween.

4. An exchanger as set forth in claim 3 wherein inner and outer tube support members have means for varying the slope of said bridge member depending on the nature of the fluid entering said inlet header.

5. An exchanger as set forth in claim 4 further comprising:

a. a plurality of continuous louvered panels mounted adjacent said tubes, said louvers being shaped to prevent coolant liquid from passing therethrough, and b. a circumferentially extending lip on said pan means to catch said coolant liquid dropping from said louvered panels.

6. In a heat exchanger of the type having a vertically disposed inlet header for receiving the fluid to be cooled, a plurality of tubes connected to said inlet header at vertically spaced points, each tube having a plurality of convolutions which slope in proceeding outwardly to the larger diameter convolutions forming an annular assembly, a vertically disposed outlet header connected to each of said tubes at the outer periphery of the annular assembly for guiding the cooled fluid from the outer ends of said tubes, said annular assembly having an open, unobstructed central area defined by the inner convolutions of said tubes, means for drawing air over all the circumferential portions of said tubes, means for dispensing a coolant liquid over the outside of said tubes, and pan means beneath said coils to collect said water, the improvement comprising:

a. a plurality of vertically disposed, circumferentially spaced-apart outer coil support members adjacent said larger diameter convolutions, b. a plurality of vertically disposed, circumferentially spaced-apart inner coil support members adjacent said smaller diameter convolutions, each of said inner coil support members being in spaced apart radial alignment with an outer coil support member, and c. bridge means extending between said inner and outer coil support members for supporting each of said vertically spaced plurality of convolutions in said sloping manner, said bridge means having spaced-apart scalloped portions which separate said convolutions of each tube to permit said air and water to circulate therebetween.

7. The heat exchanger in claim 6 wherein said inner and outer coil support members have means for varying the slope of said bridge member depending on the nature of the fluid entering said inlet header.

8. The heat exchanger in claim 6 wherein said heat exchanger has a plurality of contiguous panels mounted adjacent said larger diameter tube convolutions, each of said panels having a plurality of louvers shaped to direct water back toward said convolutions, and wherein said pan means has a circumferentially extending lip for receiving the lower edge of said panels to thereby direct water dripping therefrom into said pan.

* * * * *